US006025805A

United States Patent [19]

Smith et al.

[11] Patent Number: 6,025,805

[45] Date of Patent: Feb. 15, 2000

[54] INVERTED-E ANTENNA

[75] Inventors: Martin Stevens Smith, Chelmsford; Ian Paul Llewellyn, Harlow, both of United Kingdom

[73] Assignee: Northern Telecom Limited, Montreal, Canada

[21] Appl. No.: 08/988,562

[22] Filed: Dec. 11, 1997

[30] Foreign Application Priority Data

Dec. 31, 1996 [GB] United Kingdom ..... 9627091

[51] Int. Cl.[7] ..... H01Q 1/24

[52] U.S. Cl. ..... 343/702; 343/700 MS

[58] Field of Search ..... 343/702, 700 MS, 343/846; 455/90; H01Q 1/24

[56] References Cited

U.S. PATENT DOCUMENTS

| | | | |
|---|---|---|---|
| 4,516,127 | 5/1985 | Siwiak | 343/702 |
| 5,828,346 | 10/1998 | Park | 343/702 |

FOREIGN PATENT DOCUMENTS

| | | |
|---|---|---|
| 0177362 A2 | 4/1986 | European Pat. Off. . |
| 0642189A1 | 3/1995 | European Pat. Off. . |
| 2240219 | 7/1991 | United Kingdom . |
| 2284712 | 6/1995 | United Kingdom . |
| WO95/02284 | 1/1995 | WIPO . |

OTHER PUBLICATIONS

XP002016998 "Transmission–Line Missile Antennas" IRE Transactions on Antennas and Propagation Ronald King, C W Harrison, Jr, D H Denton, Jr.

*Primary Examiner*—Hoanganh Le
*Attorney, Agent, or Firm*—Lee, Mann, Smith, McWilliams, Sweeney & Ohlson

[57] ABSTRACT

The present invention relates to radio communications antennas and in particular relates to an antenna for such. An inverted E antenna is disclosed comprising a radiating element and a ground plane. The antenna is suitable for placement in a mobile communications handset. The antenna finds particular applicability in dual mode handsets, where two or more antennas may be located in close proximity. The small dimensions of the antenna relative to the operating wavelength, achieved by folding back an element of the antenna provides a simple solution to such problems as antenna coupling since its small size allows it to be placed as far away as possible within the small confines of a radio communications handset. A method of operating a mobile communications arrangement is also disclosed, the arrangement comprising a microphone, an audio speaker, a transceiver, and an antenna; wherein the antenna is in the form of an inverted E.

8 Claims, 7 Drawing Sheets

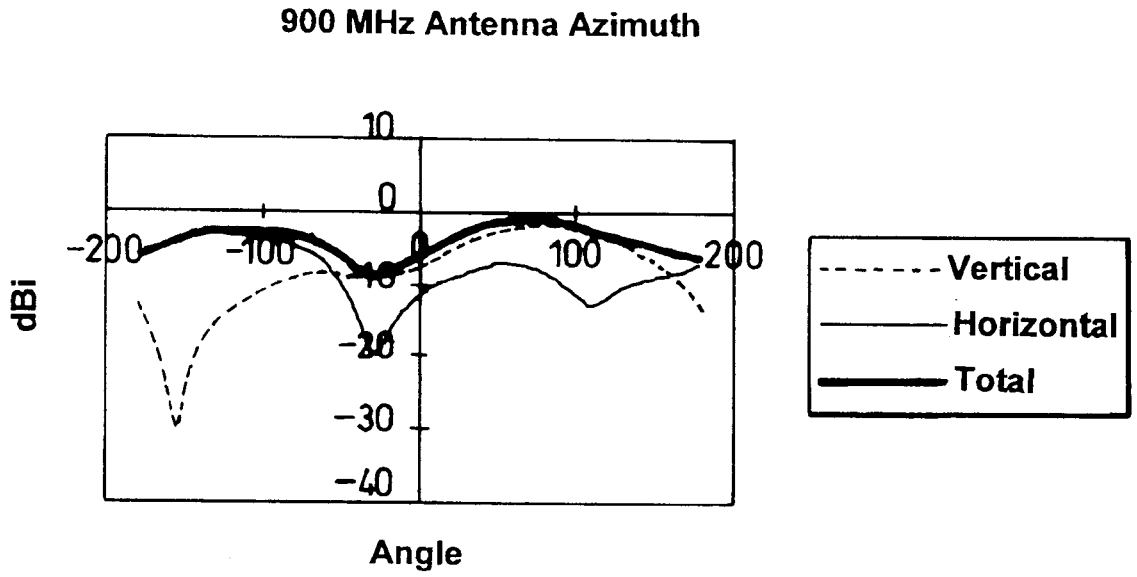
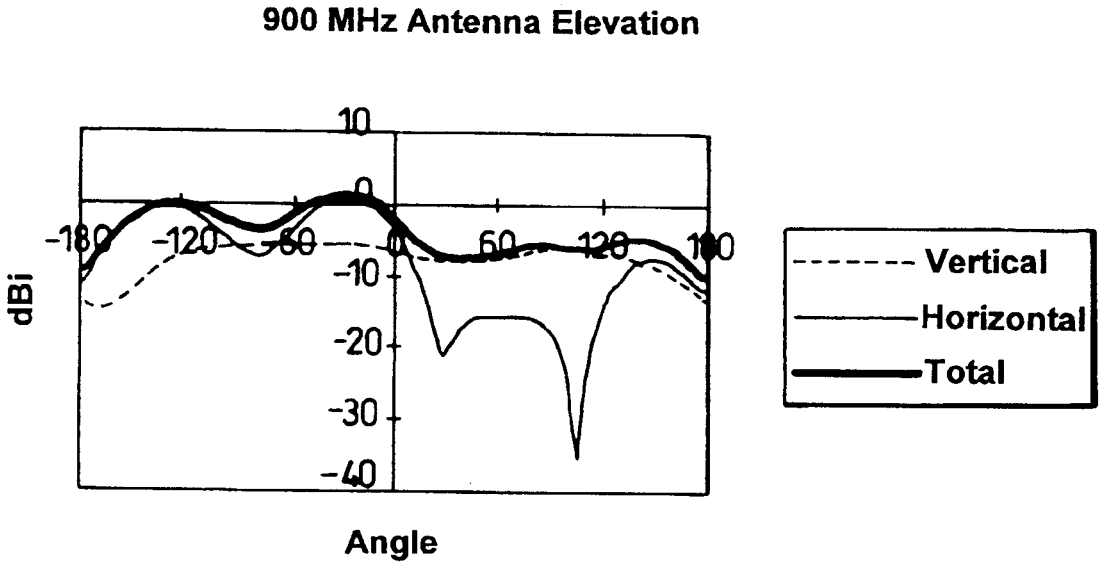
*Fig. 6*

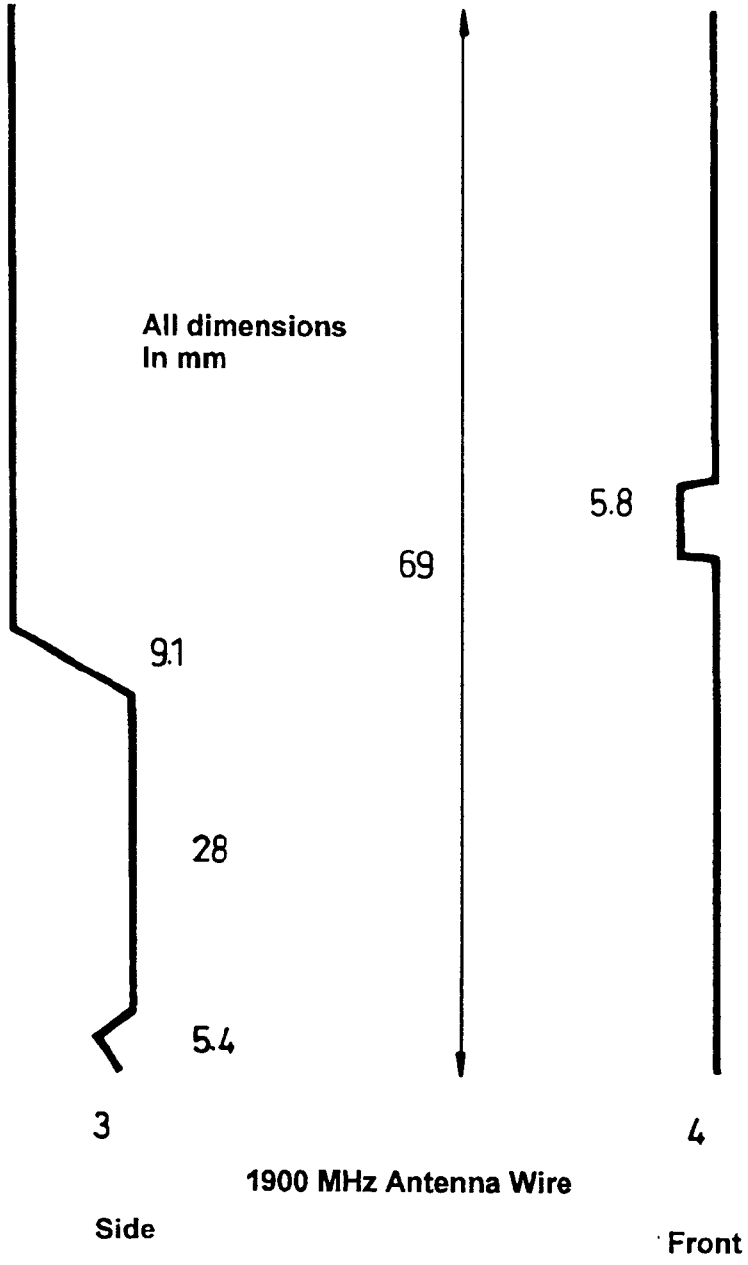
*Fig. 7a* *Fig. 7b*

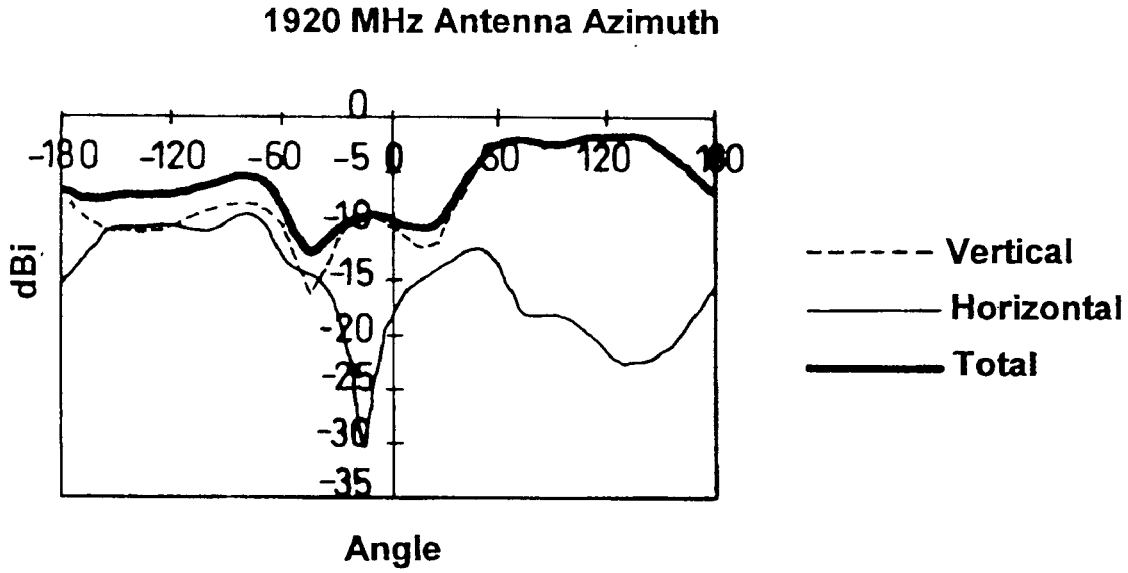
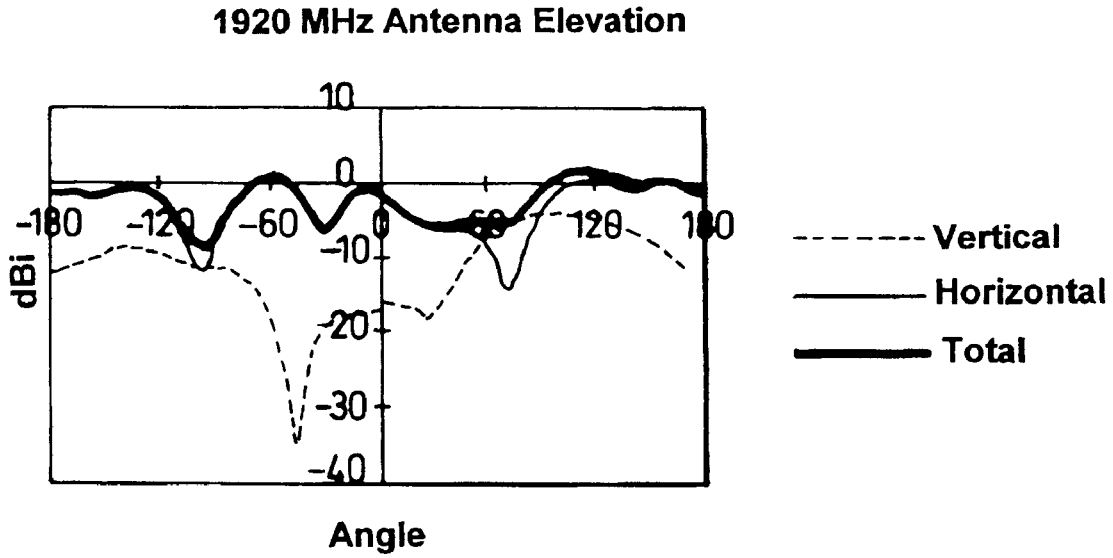
*Fig. 9*

INVERTED-E ANTENNA

FIELD OF THE INVENTION

The present invention relates to radio communications antennas and in particular relates to an antenna for such.

BACKGROUND OF THE INVENTION

As circuit size decreases in many mobile communications devices, and associated plastics housings and the like reduce in size, mobile radio handsets are becoming of ever decreasing size. One item of a radio communications device which cannot easily be reduced in size is the antenna. Typically the antenna is one half or one quarter of a wavelength in length along at least one axis and as such cannot easily be reduced. Several variants of antennas of a reduced size, however, have been produced.

One type of a low-profile antenna is the Inverted-L Antenna (ILA), as shown in FIG. 1. The ILA consists of a short monopole as a vertical element and a wire horizontal element attached at the end of the monopole. The height of the vertical element is usually constrained to a fraction of the wavelength. The horizontal element is not necessarily very short, and the total length (horizontal component and vertical component) usually has a length of about a quarter wavelength. For applications such as in GSM handsets, this still means that the antennas is long. A longer length is desirable as it increases antenna efficiency.

The ILA has an inherently low impedance, since the antenna is essentially a vertical short monopole loaded with a long horizontal wire at the end of the monopole. The input impedance is nearly equal to that of the short monopole plus the reactance of the horizontal wire closely placed to the ground plane. A simple and typical modification of an ILA is an Inverted-F Antenna (IFA), as shown in FIG. 2. A small Inverted-L element is attached at the end of the vertical element of an ILA and the appearance is that of a letter F facing the ground plane. This modification can allow the input impedance of an IFA to have an appropriate value to match the load impedance, without using any additional circuit between the antenna and the load.

One drawback of an ILA/IFA consisting of thin wires is the narrow bandwidth, which is typically one per cent or less of the centre frequency. To widen the bandwidth, a modification can be made by replacing the wire element by a plate or by reducing the size of the ground plane, on which the antenna is mounted.

One of the applications of Inverted-L Antennas (ILAs) with respect to portable equipment involves the placement of an antenna element on the top side of a rectangular conducting box. When the conducting box is small compared with the wavelength, the box should be included in the antenna system, since radiation currents will flow on the surface of the box and cannot be ignored.

In the last ten years there has been an world-wide explosion in standards for the radio telecommunication industry covering both cellular mobile telephony and cordless telephone products. This has led to a large number of frequency bands being in use for different systems in different countries and for the requirement for a variety of different handset units to be produced to cover for each radio transmission possibility. Whilst the performance of inverted UF antennas is good in many applications the design is too large to be placed conveniently in small apparatus such as handsets.

Further, it is advantageous to be able to use the same handset for a variety of different radio systems and to be able to switch between them. In addition to the added complexity of the handset electronics, this means the antenna arrangement has to be able to work with a variety of different frequencies and bandwidth requirements. A number of alternatives are possible for the development of dual band handset antennas have been considered. A dual band matching circuit with one antenna can be overly complex and performance can be limited. It is preferred that such dual band handsets employ two antennas, one for each frequency band. Nevertheless, coupling between adjacent antennas can then occur: the antennas need to be sufficiently spaced apart, and thus need to be of small size.

It should also be noted that antennas for personal communication services (PCS) should meet current and proposed legislation/standards for specific absorption rate (SAR).

OBJECT OF THE INVENTION

The object of the present invention is to overcome or reduce problems in packaging encountered with inverted F antennas.

It is a further object of the invention to provide an antenna of compact dimensions for inclusion within a package communications handset.

It is a still further object of the invention to provide an antenna of compact dimensions operable in at least one frequency band of operation for a dual mode handset.

STATEMENT OF THE INVENTION

In accordance with a first aspect of the invention, there is provided an inverted E antenna comprising a radiating element and a ground plane; wherein a first arm of the E is folded back towards a middle arm; the middle arm of the E is connected to ground; and a third arm of the E is connected to an RF feed.

The radiating element can be spaced a non-uniform distance from the ground plane. The ground plane can be conformal with respect to an associated housing. The ground plane can comprise a two dimensional plane.

The radiating element can comprise a shaped metal plate or can comprise a track printed on a dielectric. Microstrip fabrication techniques are widely used and can be inexpensive to implement, using boards such as FR4. Alternatively, the radiating element can comprise a rigid metallic wire. Other types of radiating element construction are possible.

The antenna is suitable for placement in a mobile communications handset. The antenna finds particular applicability in dual mode handsets, where two or more antennas may be located in close proximity. The small dimensions of the antenna relative to the operating wavelength, achieved by folding back an element of the antenna provides a simple solution to such problems as antenna coupling since its small size allows it to be placed as far away as possible within the small confines of a radio communications handset.

In accordance with a further aspect of the invention, there is provided a method of operating a mobile communications arrangement, comprising a microphone, an audio speaker, a transceiver, and an antenna; wherein the antenna is in the form of an inverted E comprising a radiating element and a ground plane; wherein a first arm of the E is folded back towards a middle arm; the middle arm of the E is connected to ground; and a third arm of the E is connected to an RF feed; the method comprising the steps of:

in a receive mode; receiving radio frequency signals with the antenna, passing the radio frequency signals from the antenna to the transceiver and converting the radio frequency signals to audio modulated electrical signals and converting the audio modulated signals to audio signals with the audio speaker; and, in a transmit mode; receiving audio frequency signals with the audio speaker and converting them to audio modulated electrical signals, passing the audio modulated signals to the transceiver and converting them to radio frequency signals, passing the radio frequency signals to the antenna and radiating the signals by the antenna.

The provision of an antenna which is of compact dimensions is of great advantage in the miniaturisation of designs and components in general and, more particularly, will find many applications in mobile communication handsets, both single band and dual band. It is to be noted that dual band designs can be more easily configured with two separately located antennas, where the likelihood of interaction between the antennas is reduced.

BRIEF DESCRIPTION OF THE DRAWINGS

In order that a greater understanding of the invention be attained, an embodiment of the invention will now be described with reference to the accompanying drawings, wherein:

FIG. 6 shows the azimuth and elevation radiation patterns for the second embodiment;

FIGS. 7*a, b* show side and front views of the 1900 MHz band antenna wire;

FIG. 9 shows anechoic chamber radiation patterns for the 1900 MHz antenna at 1920 MHz;

DETAILED DESCRIPTION

Figure 1:
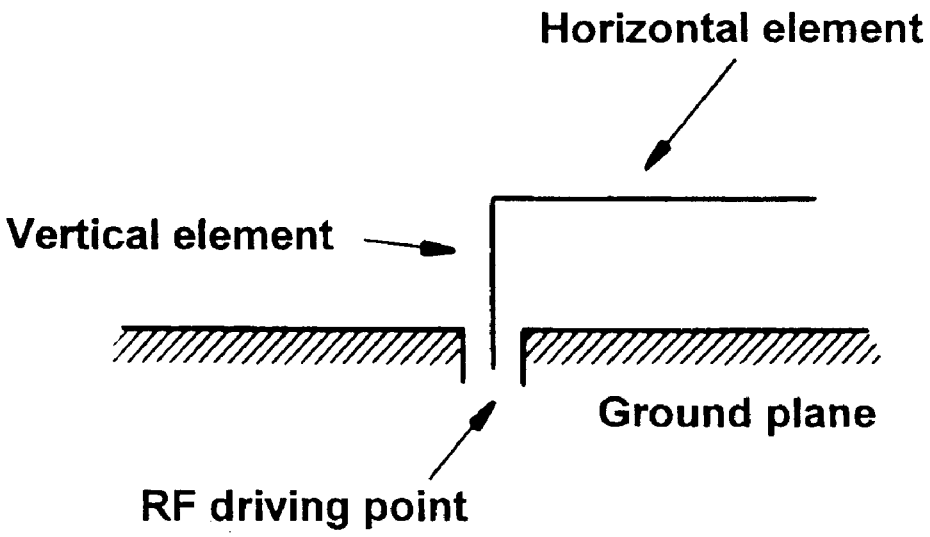
FIG. 1 shows an inverted-L antenna.
Figure 2:
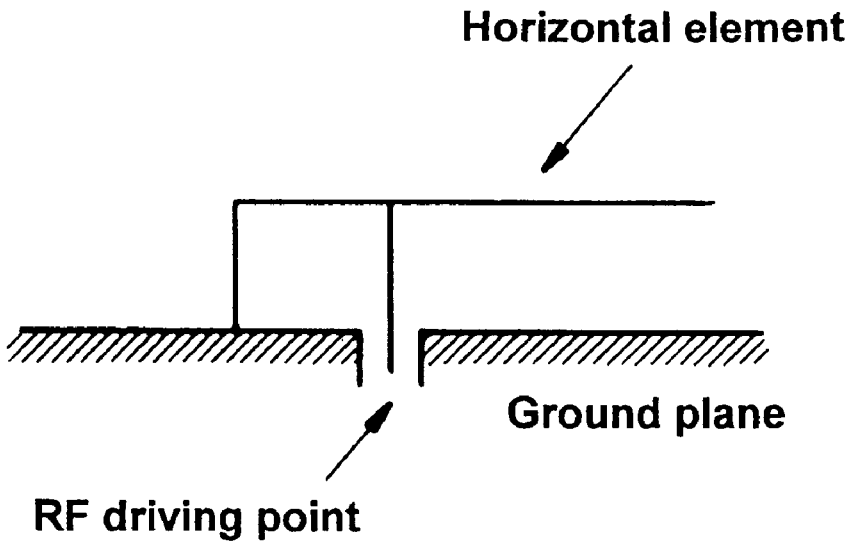
FIG. 2 shows an inverted-F antenna.
Figure 3:
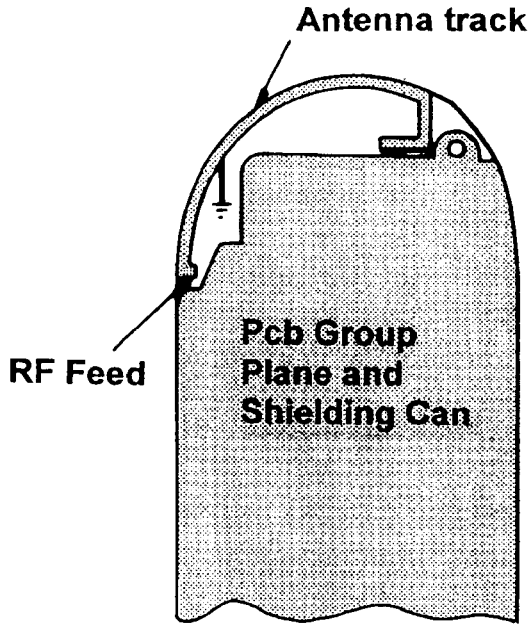
FIG. 3 shows a first embodiment of the invention.
Figure 4:
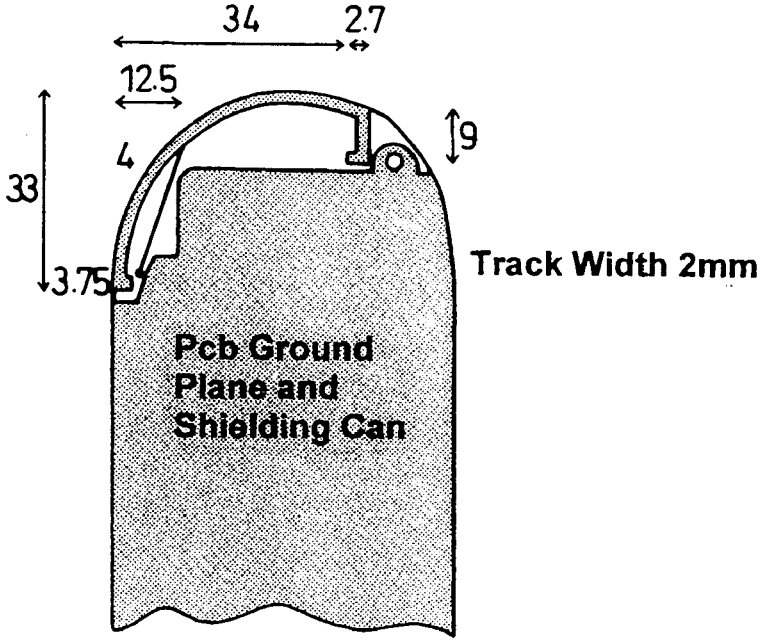
FIG. 4 shows the dimensions of a second embodiment of the invention operable at 900 MHz.

Referring now to FIG. 3, there is shown an antenna which follows the edge of a printed circuit board having a curved external shape. Two features are particularly noteworthy: the antenna is not parallel to the ground plane as in a conventional 'F' antenna; and, the antenna is folded back on itself to decrease the overall length of the structure. FIG. 4 shows the dimensions of a first embodiment operable at 900 MHz with a centre frequency of 916 MHz. In this embodiment, the earth stub comprised a piece of 0.5 mm copper wire in order to aid tuning, although this can be replaced by a track. The effects of this are such that an antenna can be fabricated to fit the shape of a board as employed in mobile telecommunications handsets.

Figure 5:
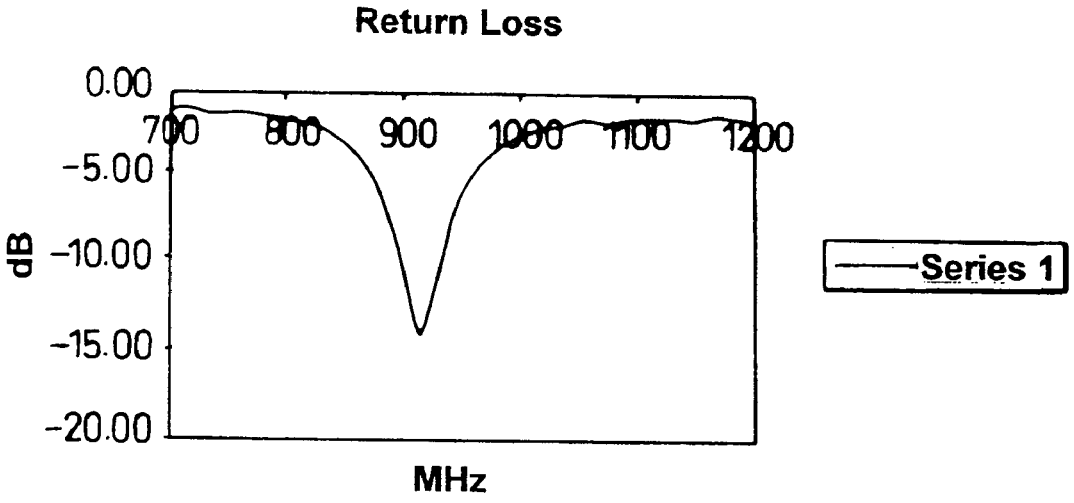
FIG. 5 shows the return loss for the second embodiment at 900 MHz.

FIG. 5 shows the return loss of the antenna shown in FIG. 4 and FIG. 6 shows the azimuth and elevation coverage of the same antenna. By measuring a large number of such cuts at different elevation angles and integrating the total power, it has been estimated that radiative efficiency is about 50%. The pattern shape and energy distribution is not particularly uniform, but in practice this is inconsequential since this will be filled in by the scattering of radiation. Note that the 10 dB return loss bandwidth of the antenna is about 30 MHz and is limited by the design and limited space of the antenna. This should, however, be adequate for most applications.

Factors which compromise the performance of antennas placed within handsets is the close proximity to circuits and shielding elements therefor. Such shielding can act like a transmission line of unknown impedance and not only will this affect the performance, but any change in the distance between the antenna and grounded shielding case will de-tune the antenna.

By keeping the antenna as far from the case as possible and by altering the case design to include a small stand-off maintains the height of the antenna at a precise distance from the ground plane and such problems can be overcome. The ground plane size and the position of the antenna was varied during experimentation, which meant that the printed circuit board matching also varied, but could be brought into match again by altering the series matching capacitors on the printed circuit board and by altering the antenna length.

For an antenna system to operate in two separate frequency bands, for example, one resonant at 900 MHz and one at 1900 MHz (PCS) bands, there are a number of constraints, reflecting the intended design of the handset. Briefly, these are: an internal printed antenna requires board space in which will always be at a premium; The length of any external antenna must not increase, e.g. by virtue of reduced space within the handset; The coupling between the 1900 MHz and 900 MHz ports were to be kept as low as possible, both from an electrical interference point of view and from the point of view of avoidance of loss in the antenna system; The performance of the PCS antenna must be as good as that for a single band handset. In particular the bandwidth required at this band in large. It would be possible, however, to use a slightly less efficient 900 MHz antenna since the range of the product is not as great. The higher gain and bandwidth requirements for PCS, means the external antenna needs to be the higher frequency one, with the smaller internal one used in 900 MHz cordless mode.

Further, there are essentially three different approaches to any dual band handset antenna design. These are: i) The use of a matching network containing discrete components linking the two ports to a single external antenna; ii) Using a single external antenna that has two sections resonant at the two frequencies; and, iii) Using two antennas, one internal and one external, for the two frequencies of interest.

The first approach requires the use of two matching networks to match the two frequencies to a single antenna, together with filter networks to prevent the RF going down the wrong arm of the network. Design of these filters is complicated by the line impedance after the matching network not being 50 Ω but being the complex impedance of the antenna.

A dual resonant antenna such as one described in Applicants co-pending patent application (Number to be assigned, but identified internally as Kitchener 9) is also suitable for use in wireless mobile communications handsets. The antenna described in this application is useful when frequency separation between bands is appropriate, which is not always the case.

The Applicants have also tested a dual antenna design, comprising a co-linear helical antenna for 900 MHz and a straight wire monopole in the centre of the helix for 1900 MHz antenna arrangement is possible, but the return loss at the two frequencies and the coupling between the two ports at 1900 MHz in particular can be severe (~4 dB), due to the proximity of the two antennas. Accordingly, this approach cannot conveniently be employed.

An antenna design made in accordance with the present invention together with the use of a straight monopole operable at 1900 MHz has been found to exhibit good performance.

Figure 8:
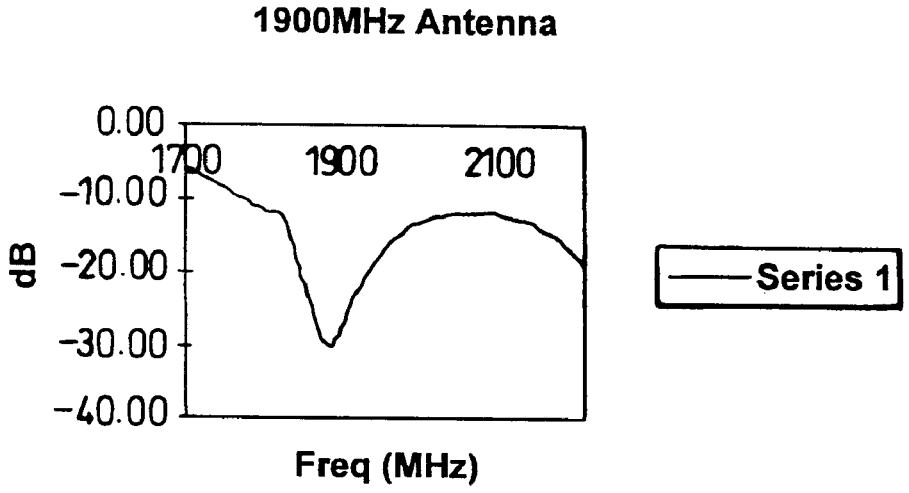
FIG. 8 shows the return loss of the external antenna.

In a wireless handset employing an E antenna operable at 900 MHz, a monopole 1900 MHz antenna was tuned by altering the value of a capacitor on the associated circuit board and altering the length of the antenna. The best match was found using a 2.2 pF capacitor and an antenna whose length is given in FIG. 7. This figure shows the length of the antenna wire inside the plastic outer casing. A reliable spring contact with the antenna must be ensured. The return loss for this design is shown in FIG. 8.

Figure 10:
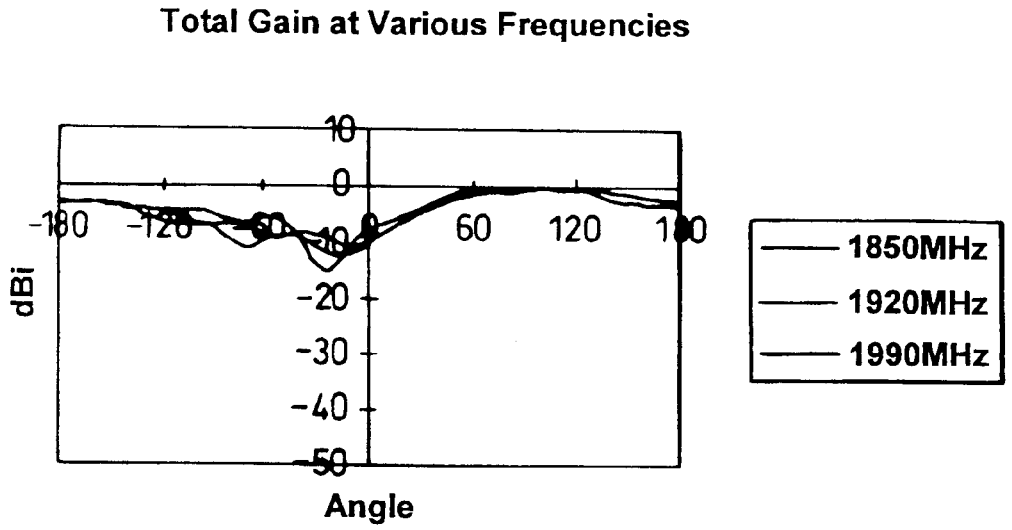
FIG. 10 shows the total gain at each end and centre of band.

FIG. 9 shows the azimuth and elevation patterns for this antenna at centre band and FIG. 10 shows the total power in azimuth (i.e. vertical plus horizontal) for the centre and two extremes of the frequency band. It can be seen that there is very little change in antenna gain with frequency, showing the antenna to be well matched. A full set of cuts showed the antenna to be 70% efficient at the centre frequency.

Figure 11:
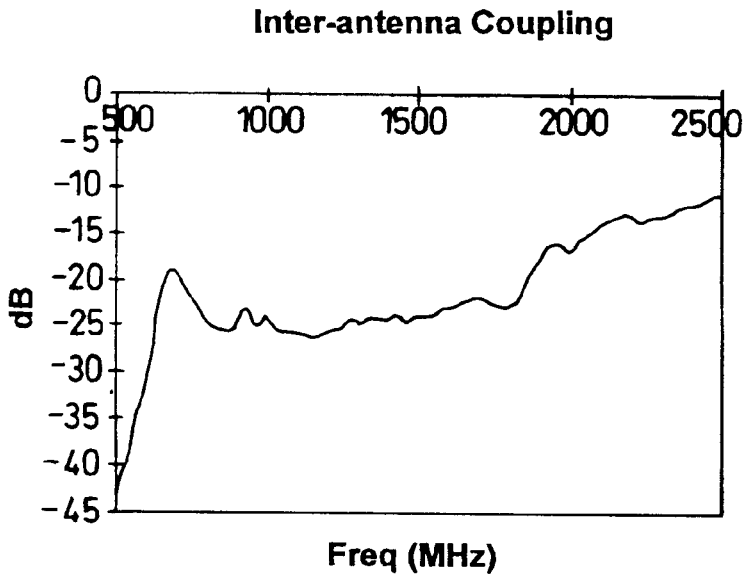
FIG. 11 shows the amount of coupling between the 900 and 1900 MHz antennas on dual board.

The external PCS antenna is longer in order to fit into the case and follows the ground plane over some of its distance and hence acts as a poorly characterised transmission line. Despite this, it has been shown that it is possible to get the antenna to tune in with a sufficiently large bandwidth by altering the matching capacitor on the PCS board and trimming the antenna length. The resulting antenna gives a high radiation efficiency (70%). In addition to the performance of both antennas, it is important that there is no appreciable coupling between the antennas. FIG. 11 shows the extent of such coupling and it can be seen that the coupling levels are quite low in both bands of interest, the worst being about −17 dB at the top edge of the PCS band.

In the limited space available for an antenna to be internally positioned within a handset led, in one configuration, to the development of a design of antenna which followed the curved outside edge of a printed circuit board. This has been shown to have an adequate bandwidth and gain for this application. The limited space also led to problems with placement of other components near to the antenna, in particular a LED indicator that was placed on the pcb directly opposite the antenna on the reverse side of the board. To overcome RF shorting problems, a low-pass filter element was placed in the feed tracks of the LED to avoid the RF being shorted to ground at this point.

An estimate of the specific absorption rate values, SAR, was made as a way of measuring the power absorbed in the tissues of the head or body. SAR is defined as the time rate at which radio-frequency electromagnetic energy is imparted to an element of mass of a biological body, and is given as $$SAR=\sigma|E|^2/2\rho$$

where $\sigma$ is the conductivity and E the peak electric field and $\rho$ is the density.

If the SAR level is low, the product is both less of a health risk and a more efficient radiator. A software package known as XFDTD was employed and calculated the SAR.

The antenna was fed with a steady state, sinusoidal source in the z (vertical) direction. The resulting steady state data was recorded as:

| | |
|---|---|
| feed point impedance: | 25.19-j14.30 |
| input power: | 0.015 W |
| radiated power: | $9.47 \times 10^{-3}$ W |
| efficiency: | 63% |

The peak SAR value, given by XFDTD was found to be in the plane z=78, with a value of $5.14\times10^{-1}$ W/kg. Using the data from this file and files z=77 and z=79,the average for 1 cell, averaged over the required 1 gram was found to be 0.1155 W/kg, which, when adjusted for the correct input power of 1 W and a duty factor of ⅛, produced the following result for the SAR:

$$0.1155\times\frac{1}{0.015}=7.7\times\frac{1}{8}=0.96\ \mathrm{W/kg}$$

Multiplying this by a correcting factor of 0.6, then the final SAR figure is 0.58 W/kg. This value is clearly below the specification of the IEEE standard 1.6 W/kg.

We claim:

1. An inverted E antenna comprising a radiating element and a ground plane; wherein a first arm of the E is folded back towards a middle arm; the middle arm of the E is connected to ground; and a third arm of the E is connected to an RF feed.

2. An antenna according to claim 1 wherein the radiating element is spaced a non-uniform distance from the ground plane.

3. An antenna according to claim 1 wherein the ground plane is conformal with respect to an associated housing.

4. An antenna according to claim 1 wherein the radiating element comprises a shaped metal plate.

5. An antenna according to claim 1 wherein the radiating element comprises a track printed on a dielectric.

6. An antenna according to claim 1 wherein the radiating element comprises a rigid metallic wire structure.

7. An antenna according to claim 1 wherein the ground plane comprises a two dimensional plane.

8. A method of operating a mobile communications arrangement, comprising a microphone, an audio speaker, a transceiver, and an antenna; wherein the antenna is in the form of an inverted E comprising a radiating element and a ground plane; wherein a first arm of the E is folded back towards a middle arm; the middle arm of the E is connected to ground; and a third arm of the E is connected to an RF feed;

the method comprising the steps of:

in a receive mode;

receiving radio frequency signals with the antenna, passing the radio frequency signals from the antenna to the transceiver and converting the radio frequency signals to audio modulated electrical signals and converting the audio modulated signals to audio signals with the audio speaker; and, in a transmit mode;

receiving audio frequency signals with the audio speaker and converting them to audio modulated electrical signals, passing the audio modulated signals to the transceiver and converting them to radio frequency signals, passing the radio frequency signals to the antenna and radiating the signals by the antenna.

* * * * *